United States Patent [19]

Jahrig et al.

[11] Patent Number: 4,540,862

[45] Date of Patent: Sep. 10, 1985

[54] VACUUM SWITCH WITH AN INSULATING STRUT

[75] Inventors: Siegfried Jahrig; Wolfgang Opitz, both of Berlin, Fed. Rep. of Germany

[73] Assignee: Siemens Aktiengesellschaft, Munich, Fed. Rep. of Germany

[21] Appl. No.: 488,762

[22] Filed: Apr. 26, 1983

[30] Foreign Application Priority Data

Apr. 27, 1982 [DE] Fed. Rep. of Germany ... 8212580[U]

[51] Int. Cl.[3] ..... H01H 33/66; H01B 17/42

[52] U.S. Cl. ..... 200/144 B; 174/140 S

[58] Field of Search ..... 200/144 B; 174/140 R, 174/140 S

[56] References Cited

U.S. PATENT DOCUMENTS 1,501,732 7/1924 Steinberger ..... 174/140 S 2,073,519 3/1937 Jackson ..... 174/140 S

*Primary Examiner*—Robert S. Macon

*Attorney, Agent, or Firm*—Kenyon & Kenyon

[57] ABSTRACT

In a vacuum switch having a switching tube arranged between a head piece and a base, each of which is fastened to a support insulator, the head piece and the base being further connected by at least one insulating strut which has, at least one end, a transverse hole for fastening means, a longitudinal hole which goes through the transverse hole and which contains a conducting part begining at the transverse hole and is rounded at the closed end of the longitudinal hole is provided. The conducting part improves the dielectric strength of the insulating strut and may be made of one or more parts.

7 Claims, 6 Drawing Figures

VACUUM SWITCH WITH AN INSULATING STRUT

BACKGROUND OF THE INVENTION

This invention relates to vacuum switches in general and more particularly to an improved vacuum switch of the type having an insulating strut.

A vacuum switch with a head piece held by an insulating support and a base held by a further insulating support, and including a switching tube arranged between the head piece and the base and at least one insulating strut connecting the head piece and the base, which has a transverse hole for receiving fastening means at each end, is described in Siemens-Zeitschrift 51 (1977), No. 4, pages 278 to 281. An insulating strut of this type is used, for instance, in vacuum circuit breakers for the medium voltage range in order to stiffen the mounting of the vacuum switching tubes consisting of insulating supports against the stresses occurring in the switching process. It has been found sufficient and practical to make the insulating struts as smooth rods, i.e. without ribs. Such rods can advantageously be made of insulating material in sheet form by subdivision. They are inexpensive and have the desired high tensile strength. However, it has been found on occasion that these insulating strusts do not fully meet the requirements with respect to dielectric strength, especially if they are used in switchgear in the upper range of the medium voltage.

As a remedy it would be possible to consider making the insulating struts not smooth, as heretofore, but with ribs similar to conventional support insulators, or in another shape which extends the leakage path. This, however, would result in considerable additional cost. For, the insulating struts would have to be made in a mold as individual parts while they have heretofore been produced by subdividing insulating material in sheet form. In addition, the high tensile strength of the present insulating struts cannot be obtained without difficulty with molded or injection molded parts.

It is known, on the other hand, that the insulating capacity of supports in medium and high voltage equipment can be increased by so-called grading electrodes which cause the influence of the fastening parts on the dielectric strength to be decreased or made ineffective (German Pat. No. 853 018; Swiss Pat. No. 279 664). It is an object of the present invention to equip the insulating struts with such grading electrodes in as simple a manner as possible.

SUMMARY OF THE INVENTION

According to the present invention, this problem is solved in a vacuum switch of the type mentioned at the outset by providing at least one end of the insulating strut with a longitudinal hole which goes through the transverse hole and extends over part of the total length of the insulating strut and which contains an electrically conducting part which starts at least at the transverse hole and is rounded at its end facing the closed end of the longitudinal hole. Through this measure, the insulating struts can continue to be used in their present form by providing them with at least one longitudinal hole. Making the hole and inserting the electrically conducting part add only a small additional cost.

A filling body of electrically conducting foam material, for example, can be considered as the conducting part. A design of the electrically conducting part in several pieces has also been found practical. In such a case the electrically conducting part consists of an abutment resting against the wall of the transverse hole, a coil spring and a ball pressed by the spring against the end of the longitudinal hole. However, a spherical rounding or a ball is also advantageous as the termination of the conducting part, where made in one piece.

The effectiveness of the electrically conducting parts can be increased by an electrically conductive coating of the wall of the longitudinal hole.

For placing the conducting part into the longitudinal hole of the insulating strut, it is found to be advantageous if the electrically conducting part extends into the part of the longitudinal hole which is located between the transverse hole and the end of the insulating strut.

DETAILED DESCRIPTION

Figure 1:
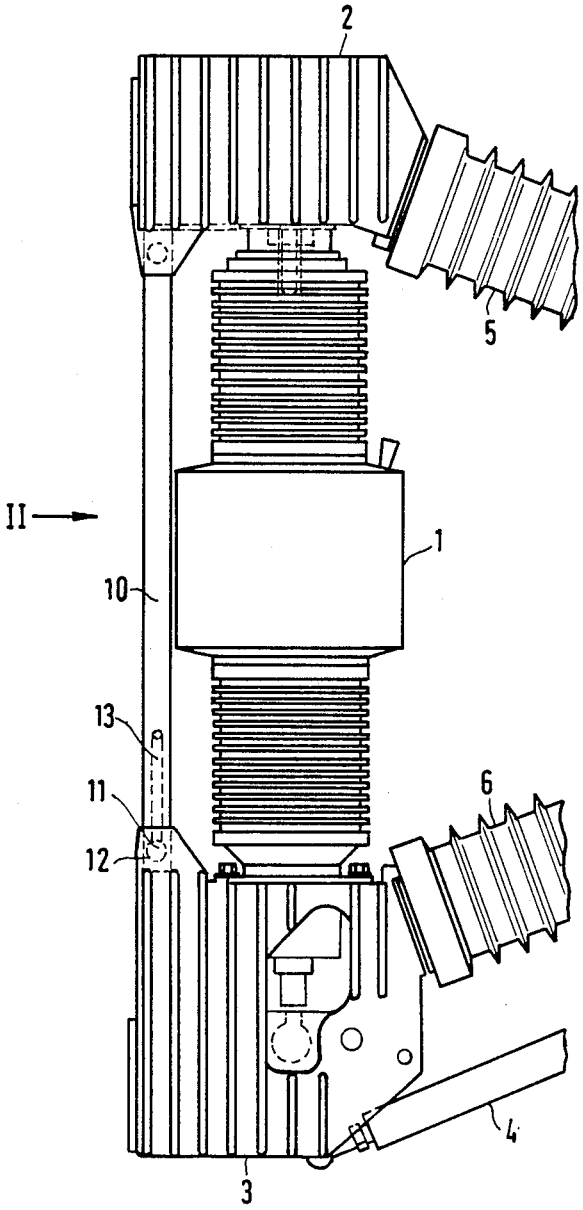
FIG. 1 is a side view of part of a vacuum circuit breaker for medium voltage.

In FIG. 1, a vacuum switching tube 1 which is arranged between a head piece 2 and a base 3 is shown. A rod 4 which is arranged so as to be movable essentially in its longitudinal direction and which acts by means of a deflection lever on the terminal stud movably guided in the longitudinal direction of the vacuum switching tube 1 is used for switching on and off.

Figure 2:
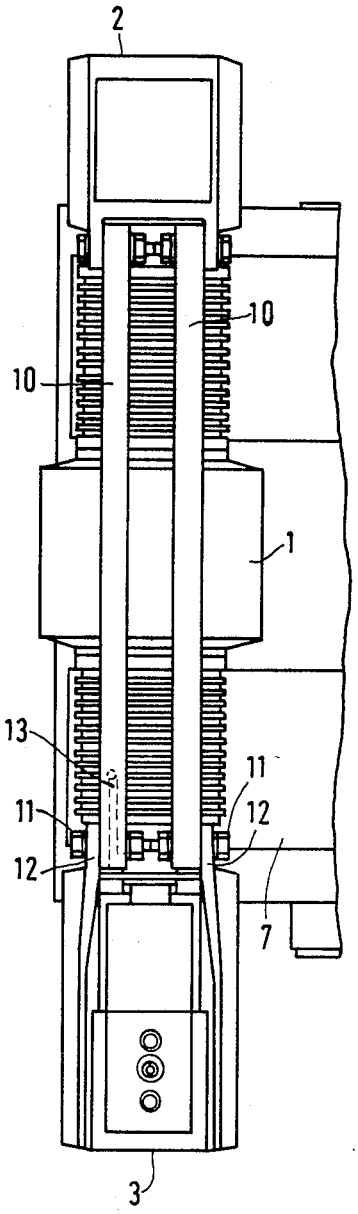
FIG. 2 is the view in the direction of the arrow II in FIG. 1.

The head piece 2 and the base 3 are supported by an upper insulating support 5 and a lower insulating support 6 which are both fastened to a frame part 7 (FIG. 2). As an additional support, two insulating struts 10 whlch are fastened by means of threaded bolts 11 to extensions 12 of the head piece 2 and the base 3 are arranged between the head piece 2 and the base 3 in a mutually parallel arrangement. The insulating struts 10, at their lower end, in addition to the transverse hole provided for the bolts 11, are provided with a longitudinal hole 13 which is indicated dashed in FIGS. 1 and 2. Further details are shown in FIGS. 3, 4, 5 and 6, in which the end of an insulating strut provided with the longitudinal hole is shown, broken-off, in cross-section.

In the various designs, the longitudinal hole extends in the same manner from the end of the insulating strut to a certain distance past a transverse hole which is used for receiving the threaded bolts 11. The diameter of the longitudinal hole is somewhat smaller than the diameter of the transverse hole, to provide the possibility of holding a part inserted into the longitudinal hole more reliably in a form-fitting manner.

Figure 3:
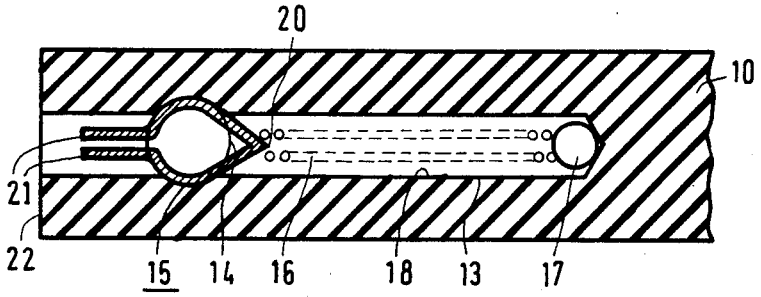
FIGS. 3 to 6 illustrate, in cross-section, the respective end regions of an insulating strut with different designs of the conducting part.

In the embodiment of FIG. 3, the insulating strut 10 is provided with a grading electrode made up of several pieces. This electrode consists of a sheet metal part 15, a coil spring 16 and a ball 17. The sheet metal part 15 acts as an abutment for the coil spring 16 and is provided for this purpose with a point 20. For handling in inserting the sheet metal part 15 into the longitudinal hole 13, legs 21 which extend into that part of the longitudinal hole which is located between the transverse hole 14 and the end 22 of the insulating strut 10 are used. Between the legs 21 and the point 20, the sheet metal part 15 is curved in accordance with the contour of the transverse hole 14 so that immovable seating is obtained after the bolts 11 are inserted.

Figure 4:
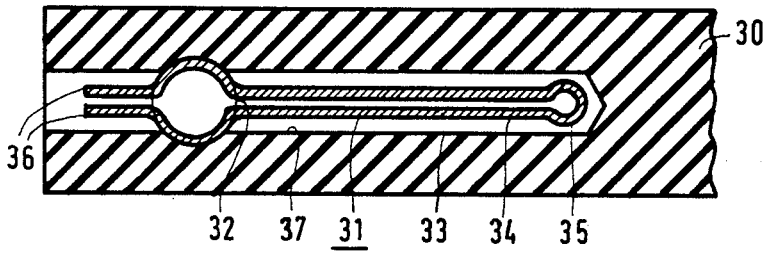

In the embodiment according to FIG. 4, the insulating strut 30 contains, with the same design of the longitudinal and transverse hole, a grading electrode 31 which is designed like the sheet metal part 15 in FIG. 3 with respect to the curvature in the region of the transverse hole 32 and the legs 36 in the outer region of the longitudinal hole 33. It is, in addition, made in one piece and has a neck piece 34 and a rounded or domed end 35.

Figure 5:
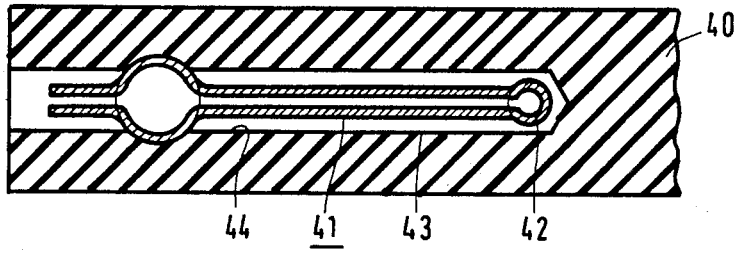

In FIG. 5, a further embodiment of an insulating strut 40 is shown, of which the part 41, acting as an advance electrode, has a ball 42 at the end of the neck piece, while the rest of the design substantially agrees with that of FIG. 4. This design improves the symmetry of the electrode at its end.

Figure 6:
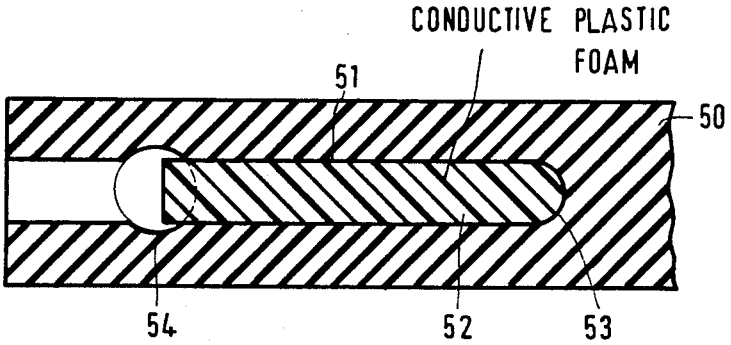

Another embodiment is shown in FIG. 6. Here, the longitudinal hole 51 is filled by a body 52 of conductive foam material. This is an elastically compressible plastic foam material which is made electrically conducting by a treatment with conductive substances.

Since, under pressure, the foam material follows the walls of the longitudinal hole 51, a desired rounding radius of the grading electrode can be obtained through the design of the end of the longitudinal hole 51. For this purpose, the longitudinal hole 51 is provided with a hemispherical end 53. The foam material body is otherwise designed so that, in the starting condition, it extends into the transverse hole 54 and, then, the desired electrical contact with the fastening means comes about by compression of the foam material when the fastening means are inserted.

In FIGS. 3, 4 and 5, the walls of the longitudinal holes 13, 33 and 43 are always provided with an electrically conductive coating 18, 37 or 44, for instance, by applying an electrically conductive varnish.

What is claimed is:

1. In a vacuum switch including an electrically conducting head piece held by a support insulator; a base held by a further support insulator; a switching tube arranged between the head piece and the base; and at least one insulating strut which connects the head piece and the base, said strut having, at each end, a transverse hole for receiving fastening means, the improvement comprising:

(a) at at least one end of the insulating strut, a longitudinal hole which has one end open at said end of said strut, goes through the transverse hole, and extends over part of the total length of the insulating strut, terminating in a closed end; and (b) an electrically conducting part disposed in said longitudinal hole which extends over part of the total length of the insulating strut beginning at least at the transverse hole, said electrically conducting part being rounded at its end facing the closed end of the longitudinal hole.

2. The improvement according to claim 1, wherein said electrically conducting part comprises an abutment resting against the wall of the transverse hole, a coil spring engaging said abutment and a ball pressed by said coil spring against the closed end of the longitudinal hole.

3. The improvement according to claim 1 or 2 wherein said electrically conducting part extends into the part of the longitudinal hole located between the transverse hole and the end of the insulating strut.

4. The improvement according to claim 3 wherein the wall of said longitudinal hole is provided with an electrically conductive coating.

5. The improvement according to claim 1 or 2 wherein the wall of said longitudinal hole is provided with an electrically conductive coating.

6. The improvement according to claim 1 wherein said conducting part comprises a body of electrically conductive foam material filling said longitudinal hole, at least between said transverse hole and said closed end.

7. The improvement according to claim 6 wherein the wall of said longitudinal hole is provided with a conductive coating.

* * * * *